US007560649B2

(12) United States Patent
Takahashi et al.

(10) Patent No.: US 7,560,649 B2
(45) Date of Patent: Jul. 14, 2009

(54) CONDUCTOR OF ELECTRIC CABLE FOR WIRING, ELECTRIC CABLE FOR WIRING, AND METHODS OF PRODUCING THEM

(75) Inventors: Isao Takahashi, Tokyo (JP); Tatsuhiko Eguchi, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 12/155,621

(22) Filed: Jun. 6, 2008

(65) Prior Publication Data

US 2008/0314612 A1 Dec. 25, 2008

Related U.S. Application Data

(63) Continuation of application No. PCT/JP2006/324383, filed on Dec. 6, 2006.

(30) Foreign Application Priority Data

Dec. 7, 2005 (JP) ..... 2005-354061
Apr. 11, 2006 (JP) ..... 2006-109192
Dec. 1, 2006 (JP) ..... 2006-326369

(51) Int. Cl.
*H01B 5/08* (2006.01)

(52) U.S. Cl. ..... 174/126.1; 174/102 R; 174/108; 174/126.2; 174/128.1

(58) Field of Classification Search ..... 174/102 R, 174/108, 113 R, 119 R, 126.1, 126.2, 128.1; 428/618, 677
See application file for complete search history.

(56) References Cited

U.S. PATENT DOCUMENTS 4,337,089 A * 6/1982 Arita et al. ..... 420/472
5,021,105 A * 6/1991 Asai et al. ..... 148/433
5,124,124 A * 6/1992 Ohashi et al. ..... 420/473
5,170,015 A * 12/1992 Kudo et al. ..... 174/128.1
6,251,199 B1 * 6/2001 Mandigo et al. ..... 148/433
6,406,566 B1 * 6/2002 Ishida et al. ..... 148/402
2005/0061405 A1 * 3/2005 Kamf ..... 148/554
2007/0062619 A1 * 3/2007 Maehara et al. ..... 148/554
2007/0131321 A1 * 6/2007 Kaneko et al. ..... 148/685
2007/0169855 A1 * 7/2007 Oishi ..... 148/434
2009/0035174 A1 * 2/2009 Era et al. ..... 420/473

FOREIGN PATENT DOCUMENTS

JP 2-197013 A 8/1990
JP 4-180532 A 6/1992
JP 5-125469 A 5/1993
JP 6-17209 A 1/1994
JP 6-52734 A 2/1994
JP 6-60722 A 3/1994
JP 092996239 * 11/1997
JP 11-224538 A 8/1999
JP 2004/022508 * 1/2004
JP 2004-269962 A 9/2004
JP 2006-225753 A 8/2006
JP 2006-283059 A 10/2006
JP 2006-307340 A 11/2006
WO WO-03/076672 A1 9/2003

* cited by examiner

*Primary Examiner*—William H Mayo, III
(74) *Attorney, Agent, or Firm*—Birch, Stewart, Kolasch & Birch, LLP

(57) ABSTRACT

A conductor of an electric cable for wiring, containing a copper alloy material containing 1.0 to 4.5 mass % of Ni, 0.2 to 1.1 mass % of Si, and the balance of Cu and unavoidable impurities, in which the copper alloy material has an average grain diameter of 0.2 to 5.0 μm.

18 Claims, No Drawings

CONDUCTOR OF ELECTRIC CABLE FOR WIRING, ELECTRIC CABLE FOR WIRING, AND METHODS OF PRODUCING THEM

This application is a Continuation of copending PCT International Application No. PCT/JP2006/324383 filed on Dec. 6, 2006, which designated the United States, and on which priority is claimed under 35 U.S.C. § 120. This application also claims priority under 35 U.S.C. § 119(a) on Patent Application No(s). 2005-354061, 2006-109192 and 2006-326369 filed in Japan on Dec. 7, 2005, Apr. 11, 2006 and Dec. 1, 2006, respectively. The entire contents of each of the above documents is hereby incorporated by reference.

TECHNICAL FIELD

The present invention relates to a conductor of an electric cable for wiring, an electric cable for wiring, and methods of producing them.

BACKGROUND ART

Conventionally, as an electric cable for automobile wiring, an electric cable including: a stranded conductor obtained by stranding annealed copper wires according to JIS C 3102 or annealed copper wires subjected to tin plating or the like, as a conductor; and an insulator such as vinyl chloride or crosslinked polyethylene concentrically covering the conductor, is mainly used. In recent years, with an increased number of wiring positions caused by, for example, increase of various control circuits to be loaded in an automobile, a demand for durability and long time current-carrying property at a joint or the like has further increased.

Meanwhile, a proportion of a signal current circuit for control or the like has increased in an automobile wiring circuit, and a weight of an electric cable to be used has increased.

On the other hand, from viewpoints of energy conservation and the like, reduction in weight of an automobile has been required. As a measure of the requirement, weight reduction caused by reduction in diameter of a conductor of an electric cable is required. However, reduction in diameter of a conventional conductor of an electric cable involves difficulties, because the conductor itself of an electric cable and its terminal crimp part each have low mechanical strength even though the conductor of an electric cable has a sufficient current-carrying capacity.

There is proposed an example of a conductor of an electric cable produced by using a copper alloy material, which has high strength and a small wire diameter (see, for example, the Patent Document 1). Further, there is proposed an example of a conductor of an electric cable produced by stranding a plurality of copper alloy wire(s) and hard drawn copper wire(s), which has excellent mechanical and electrical properties but hardly coils (see, for example, the Patent Document 2). However, for the electric cable, required properties have become tough with improved performance of an automobile, and bending resistance is required, in particular. The electric cable is required not to break even after flexing 1,000,000 times, for example, and the conventional electric cables are not capable of satisfying such requirements.

[Patent Document 1] JP-A-6-60722 ("JP-A" means unexamined published Japanese patent application)

[Patent Document 2] JP-A-11-224538

DISCLOSURE OF INVENTION

In view of problems described above, an object of the present invention is to provide a conductor of an electric cable for wiring having excellent bending resistance, strength (tensile strength and crimp strength), and electric conductivity, and a method of producing the conductor of an electric cable for wiring.

Another object of the present invention is to provide an electric cable for wiring formed by using the excellent conductor of an electric cable for wiring described above, and a method of producing the same.

The inventors of the present invention have conducted extensive studies, and have found that a conductor of an electric cable for wiring having excellent bending resistance can be produced by adjusting a grain diameter of a copper alloy having a specific composition to a specific value.

According to the present invention, there is provided the following means:

(1) A conductor of an electric cable for wiring, comprising a copper alloy material containing 1.0 to 4.5 mass % of Ni, 0.2 to 1.1 mass % of Si, and the balance of Cu and unavoidable impurities, wherein the copper alloy material has an average grain diameter of 0.2 to 5.0 μm;

(2) A conductor of an electric cable for wiring, comprising a copper alloy material containing 1.0 to 4.5 mass % of Ni, 0.2 to 1.1 mass % of Si, at least one of 0 to 1.0 mass % of Sn, 0.005 to 0.2 mass % of Fe, 0.005 to 0.2 mass % of Cr, 0.05 to 2 mass % of Co, 0.005 to 0.1 mass % of P and 0.005 to 0.3 mass % of Ag, and the balance of Cu and unavoidable impurities, wherein the copper alloy material has an average grain diameter of 0.2 to 5.0 μm;

(3) The conductor of an electric cable for wiring according to the above item (1) or (2), wherein a copper alloy of the copper alloy material further contains at least one of 0.01 to 0.5 mass % of Mn and 0.05 to 0.5 mass % of Mg;

(4) The conductor of an electric cable for wiring according to any one of the above items (1) to (3), wherein a copper alloy of the copper alloy material further contains 0.1 to 1.5 mass % of Zn;

(5) A method of producing the conductor of an electric cable for wiring according to any one of the above items (1) to (4), which conducts hot extrusion;

(6) An electric cable for wiring formed by stranding a plurality of the conductors of an electric cable for wiring according to any one of the above items (1) to (4);

(7) A method of producing the electric cable for wiring according to the above item (6), comprising the steps of:

subjecting a copper alloy to solution treatment;

stranding a plurality of conductors of an electric cable each obtained by drawing the copper alloy subjected to said solution treatment to a predetermined wire diameter;

compressing the plurality of conductors stranded; and conducting age annealing of the plurality of conductors stranded and compressed at 300 to 550° C. for 1 minute to 5 hours;

(8) A method of producing the electric cable for wiring according to the above item (6), comprising the steps of:

subjecting a copper alloy to solution treatment;

conducting age annealing of a plurality of conductors of an electric cable each obtained by drawing the copper alloy subjected to said solution treatment to a predetermined wire diameter at 300 to 550° C. for 1 minute to 5 hours;

stranding the plurality of conductors age-annealed; and compressing the plurality of conductors age-annealed and stranded; and (9) A method of producing the electric cable for wiring according to the above item (6), comprising the steps of:

subjecting a copper alloy to solution treatment;

conducting age annealing of a plurality of conductors of an electric cable each obtained by drawing the copper alloy subjected to said solution treatment to a predetermined wire diameter at 300 to 550° C. for 1 minute to 5 hours;

stranding the plurality of conductors age-annealed;

compressing the plurality of conductors age-annealed and stranded; and conducting low-temperature annealing for distortion relieve of the plurality of conductors age-annealed, stranded and compressed.

Other and further features and advantages of the invention will appear more fully from the following description.

BEST MODE FOR CARRYING OUT THE INVENTION

A preferred embodiment of a copper (Cu) alloy material to be used for the conductor of an electric cable for wiring of the present invention is described in detail. First, actions and effects of each alloy element and a content of each alloy element is described in detail.

Nickel (Ni) and silicon (Si) are elements to be included for forming Ni—Si precipitates ($Ni_2Si$) in a matrix by controlling a content ratio of Ni to Si, thereby precipitation-strengthening and improving strength of a copper alloy. A content of Ni is 1.0 to 4.5 mass %, and preferably 1.2 to 4.2 mass %. If the content of Ni is too low, an amount of the precipitation hardening is small, strength is insufficient, and bending resistance is inferior. If the content of Ni is too high, grain boundary precipitates is caused during heat treatment and bending resistance is inferior.

Si is known to provide a maximum strengthening amount in an amount of about ¼ of the Ni content, when the Si content is shown in terms of mass %. In the present invention, the Si amount is 0.2 to 1.1 mass %, and preferably 0.3 to 1.0 mass %.

The copper alloy material to be used in the present invention preferably contains at least one of tin (Sn), iron (Fe), chromium (Cr), cobalt (Co), phosphorus (P), and silver (Ag). These elements have similar functions as Ni and Si, in views of enhancing strength and improving bending resistance. In the case these elements are included, at least one element selected from the group consisting of Sn, Fe, Cr, Co, P, and Ag is included in a total amount of preferably 0.005 to 2 mass %, and more preferably 0.01 to 1.5 mass %.

Sn is capable of improving strength and bending resistance by forming a solid solution of Sn in Cu and distorting a lattice. However, if the Sn content is too high, the electric conductivity is reduced. Thus, when Sn is included, the Sn content is preferably 0 to 1.0 mass %, and more preferably 0.05 to 0.2 mass %.

Fe and Cr each bond with Si and form a Fe—Si compound and a Cr—Si compound for enhancing strength. Further, Fe and Cr each have an effect of trapping Si remained in a Cu matrix without forming a compound with Ni, to thereby improve electric conductivity. The Fe—Si compound and the Cr—Si compound each have low precipitation hardening ability, and thus it is not advisable to form large amounts of the compounds. Further, if contents of contained Fe and Cr are more than 0.2 mass %, bending resistance tends to deteriorate. From such viewpoints, a content of each of Fe and Cr to be included is preferably 0.005 to 0.2 mass %, and more preferably 0.03 to 0.15 mass %.

Co forms a compound with Si and enhances strength, similar to Ni. A conductor of an electric cable for wiring according to the preferred embodiment of the present invention uses a Cu—Ni—Si-based alloy, because Co is more expensive than Ni. However, when possible costwise, a Cu—Co—Si-based alloy or a Cu—Ni—Co—Si-based alloy may be selected. The Cu—Co—Si-based alloy has slightly enhanced strength and electric conductivity than those of the Cu—Ni—Si-based alloy, after age precipitation. Thus, the Cu—Co—Si-based alloy is effective for applications emphasizing those properties. From those viewpoints, when Co is contained, the Co content is preferably 0.05 to 2 mass %, and more preferably 0.08 to 1.5 mass %.

P has an effect of enhancing strength. However, a high P content degrades electric conductivity, accelerates grain boundary precipitation, and degrades bending resistance. Thus, when P is contained, the P content is preferably 0.005 to 0.1 mass %, and more preferably 0.01 to 0.05 mass %.

Ag enhances strength, prevents grain diameter from increasing, and improves bending resistance. In general, if the Ag content is less than 0.005 mass %, a sufficient effect cannot be provided; to the contrary, if the content of included Ag is more than 0.3 mass %, no adverse effects on the properties is provided but cost increases. From those viewpoints, the content of Ag to be included is preferably 0.005 mass % to 0.3 mass %, and more preferably 0.01 to 0.2 mass %.

Further, in the present invention, at least one of magnesium (Mg) and manganese (Mn) is preferably included. These elements have similar functions to the above-mentioned elements of preventing embrittlement during heating and improving hot working property. In particular, a conductor having a small diameter is used in the present invention, but in the case where an embrittled part is present in a material, the conductor cannot be drawn to a small diameter. Thus, these elements are preferably included. In the case where Mg and Mn is included, at least one of Mg and Mn is included in a total amount of preferably 0.01 to 0.5 mass %, and more preferably 0.05 to 0.3 mass %.

The Mg content is preferably 0.05 to 0.5 mass %, and more preferably 0.09 to 0.3 mass %. If the Mg content is less than 0.05 mass %, only a small effect is provided in some cases. To the contrary, if the Mg content is more than 0.5 mass %, electric conductivity deteriorates and cold working property deteriorates, to thereby inhibit drawing to a small diameter, in some cases.

If the Mn content is less than 0.01 mass %, only a small effect is provided in some cases. To the contrary, if the Mn content is more than 0.5 mass %, not only an effect corresponding to the content cannot be provided but also electric conductivity may deteriorate. Thus, the Mn content is preferably 0.01 to 0.5 mass %, and more preferably 0.1 to 0.35 mass %.

Further, zinc (Zn) is preferably included in the present invention. Zn has an effect of preventing degradation of adhesion with solder due to heating. In the present invention, Zn is included, to thereby significantly improve embrittlement of solder when a conductor is bonded by soldering. The Zn content in the present invention is preferably 0.1 to 1.5 mass %, and more preferably 0.4 to 1.2 mass %. If the Zn content is less than 0.1 mass %, such an effect cannot be provided in some cases. To the contrary, if the Zn content is too large, electric conductivity may deteriorate, in some cases.

Next, an alloy structure of the copper alloy material to be used in the present invention is described.

The copper alloy material to be used in the present invention has an average grain diameter of 0.2 to 5.0 μm. An average grain diameter of more than 5.0 μm significantly degrades bending resistance. An average grain diameter of less than 0.2 μm causes incomplete recrystallization and likely provides a structure including non-recrystallized grains. Thus, bending resistance degrades. The average grain diameter of the copper alloy material is preferably 0.5 to 4.5 μm.

Further, a density of precipitates, which are intermetallic compounds comprising Ni and Si, is preferably 1 to 30 precipitates, and more preferably 3 to 20 precipitates, per sectional area of 1 $\mu m^2$, from viewpoints of improving strength and bending resistance. Further, from the viewpoints of improving strength and bending resistance, a size of the precipitates, which are intermetallic compounds comprising Ni and Si, is preferably 0.01 to 0.3 μm, and more preferably 0.05 to 0.2 μm. In the present invention, "grain" referred to in the average grain diameter does not include the precipitate of the intermetallic compound.

The conductor of an electric cable for wiring of the present invention can be produced by: hot extruding a copper alloy forming the copper alloy material under heating at preferably 700 to 1,000° C., and more preferably 800 to 950° C. for reducing the grain diameter; immediately after the hot extruding, conducting water hardening the hot-extruded copper alloy to produce a round bar; and drawing the round bar to a predetermined diameter (wire diameter). The diameter is not particularly limited, but is preferably 0.05 to 0.4 mm, and more preferably 0.1 to 0.35 mm.

A conventional method involves holding a copper alloy in a batch furnace at 900 to 950° C. for 1 to 2 hours. However, when a copper alloy is subjected to a heat treatment at a high temperature for a long time, the grain diameter increases and bending resistance deteriorates. Thus, in the present invention, solution treatment is conducted by hot extrusion without use of a batch furnace. In this way, rapid cooling immediately after extrusion can prevent grains from enlarging.

For example, the electric cable for wiring of the present invention can be produced by: stranding a plurality of the conductors of an electric cable for wiring; compressing the stranded conductors; and conducting age annealing of the stranded and compressed conductors at preferably 300 to 550° C. and more preferably 350 to 500° C. for preferably 1 minute to 5 hours and more preferably 30 minutes to 4 hours.

Alternatively, the electric cable for wiring of the present invention may be produced by: stranding a plurality of the conductors of an electric cable for wiring; and, without compressing, conducting age annealing of the stranded conductors at preferably 300 to 550° C. and more preferably 350 to 500° C. for preferably 1 minute to 5 hours and more preferably 30 minutes to 4 hours.

Alternatively, the electric cable for wiring of the present invention may be produced by: conducting age annealing of a plurality of the conductors of an electric cable for wiring at preferably 300 to 550° C. and more preferably 350 to 500° C. for preferably 1 minute to 5 hours and more preferably 30 minutes to 4 hours; and stranding the plurality of the conductors age-annealed.

Alternatively, the electric cable for wiring of the present invention may be produced by: conducting age annealing of a plurality of the conductors of an electric cable for wiring at preferably 300 to 550° C. and more preferably 350 to 500° C. for preferably 1 minute to 5 hours and more preferably 30 minutes to 4 hours; stranding the plurality of the conductors age-annealed; and compressing the age-annealed and stranded conductors.

In addition, the electric cable for wiring may be also produced by: conducting age annealing of a plurality of the conductors of an electric cable for wiring at preferably 300 to 550° C. and more preferably 350 to 500° C. for preferably 1 minute to 5 hours and more preferably 30 minutes to 4 hours; stranding the plurality of the conductors age-annealed; compressing the age-annealed and stranded conductors; and conducting low temperature annealing for distortion relieve of the conductors age-annealed, stranded and compressed.

The low temperature annealing can be conducted by an ordinary annealing method such as flying annealing, current-applying heating, and batch annealing. In flying annealing, the low temperature annealing is conducted at preferably 300 to 700° C. and more preferably 350 to 650° C. for preferably 1 to 600 seconds and more preferably 3 to 100 seconds. In current-applying heating, the low temperature annealing is conducted at an applied voltage of preferably 1 to 100 V and more preferably 2 to 70 V for preferably 0.2 to 150 seconds and more preferably 1 to 50 seconds. In batch annealing, the low temperature annealing is conducted under heating at preferably 200 to 550° C. and more preferably 250 to 500° C. for preferably 5 to 300 minutes and more preferably 10 to 120 minutes.

In the strand, three to fifty conductors are preferably stranded, and five to thirty conductors are more preferably stranded. An electric cable can be produced by an ordinary method by using them.

Conventionally, solution treatment is conducted by holding a material in a batch furnace at 900 to 950° C. for 1 to 2 hours. However, in this method, the grain diameter increases, and the bending resistance degrades.

In the present invention, the grain diameter can be controlled by adjusting a working rate before the solution treatment, and the temperature and time of the solution treatment. A small grain diameter can be obtained by this method without conducting hot extrusion. For example, the conductor of an electric cable for wiring of the present invention can be produced, even if a wire rod produced through continuous casting is used.

The conductor of an electric cable for wiring of the present invention has excellent bending resistance and strength (tensile strength and crimp strength). Further, the conductor of an electric cable for wiring of the present invention is capable of preventing hot cracking during production of the conductor and has excellent workability during drawing to a small diameter.

The method of producing a conductor of an electric cable for wiring of the present invention allows production of the conductor of an electric cable for wiring having excellent physical properties described above.

The electric cable for wiring of the present invention is capable of reducing a weight of the electric cable by reducing a diameter of the conductor and is suitable as a signal electric cable for an automobile, robot or the like.

The method of producing an electric cable for wiring of the present invention allows production of the electric cable for wiring having excellent properties described above.

The present invention will be described in more detail based on examples given below, but the invention is not meant to be limited by these.

EXAMPLE 1

An alloy of a composition including alloy components as shown in Table 1 was melted in a high frequency melting furnace, to thereby cast each billet. Next, in Examples 1 to 48 of the present invention and Comparative Examples 1 to 11, the billet was hot extruded at 900° C. and water hardened immediately, to thereby obtain a round bar. Then, the round bar was cold drawn, to thereby obtain a solid conductor having a diameter of 0.18 mm. Seven of the thus-obtained solid conductors were stranded and compressed into a stranded conductor, and the stranded conductor was age annealed at 450° C. for 2 hours. In Examples 49 to 51 of the present invention, the billet was hot extruded at 900° C. and water hardened immediately, to thereby produce a round bar. Then, the round bar was cold drawn, to thereby obtain a solid conductor having a diameter of 0.18 mm. The solid conductor was age annealed at 450° C. for 2 hours, and seven of the thus-obtained solid conductors were stranded and compressed, to thereby produce a stranded conductor. In Examples 52 to 54 of the present invention, the stranded conductor was further low temperature annealed for 10 seconds in a flying annealing furnace at 550° C.

In Comparative Examples 12 to 16, the billet was hot extruded at 900° C. and water hardened immediately, to thereby obtain a round bar. Then, the round bar was cold drawn, held in a batch furnace at 950° C. for 2 hours, water hardened, and cold drawn, to thereby obtain a solid conductor having a diameter of 0.18 mm. Seven of the thus-obtained solid conductors were stranded and compressed into a stranded conductor, and the stranded conductor was age annealed at 450° C. for 2 hours.

Conventional Examples 1 and 2 were conducted in the same manner as in Example 1 of JP-A-6-60722. That is, an alloy was melted and cast into an ingot. The ingot was cold cast to a diameter of 16 mm, subjected to solution treatment under heating at 950° C. for 2 hours, and water hardened. The thus-obtained hardened material was drawn to a predetermined diameter, to thereby produce a solid conductor. Seven of the thus-obtained solid conductors were stranded into a stranded conductor, and the stranded conductor was subjected to age annealing treatment in vacuum under heating at 460° C. for 2 hours.

Using the stranded conductors, conductors of an electric cable each having a conductor sectional area of 0.13 sq ($mm^2$) and a length of 1 km, were produced. Note that the conductor(s) of an electric cable according to the present invention was referred to as "Example(s)", and the other electric cable conductor(s) was referred to as "Comparative example(s)" or "Conventional examples(s)".

[1] Tensile strength, [2] electric conductivity, [3] grain diameter, and [4] bending resistance of each of the thus-obtained conductors of an electric cable were investigated by the following methods. A measurement method of each evaluation item is described below.

[1] Tensile Strength

The tensile strength of each of three conductors was measured in accordance with JIS Z 2241, and its average value (MPa) was obtained. Note that for practical use, a tensile strength of 540 MPa or less provides insufficient strength and breaking may be caused during wiring.

[2] Electric Conductivity

The electric conductivity of each of two conductors was measured in a thermostatic tank controlled at 20° C. (±1° C.) by using a four-terminal method, and its average value (% IACS) was obtained. The distance between the terminals was set to 100 mm. Note that for practical use, an electric conductivity of 40% IACS or less cannot assure electric properties required for an electric cable.

[3] Grain Diameter

The grain diameter was measured in accordance with JIS H 0501 (intercept method) and on a surface perpendicular to a longitudinal direction of the electric cable. A scanning electron microscope (SEM) was used for the measurement. The grain diameter of each of three arbitrary positions was observed, and an average value of the obtained grain diameters was used.

[4] Bending Resistance

In a bending test, the conductor of an electric cable as a test sample was clamped with a mandrel, and a load was applied thereto by hanging a weight on a lower end of the sample for suppressing distortion of the cable. In this state, the electric cable was bent to right and left sides by 30°, and the number of bending until breaking of the conductor was measured for each sample. Note that right and left bending was counted as one (1) flexing, and the bending was conducted at a speed of 100 times/minute. The mandrel diameter was Φ30 mm, and the weight was 200 g. The number of bending until breaking was measured by the number of bending required for the conductor to break with falling of the weight hung on the lower end of the sample. In the case where the conductor did not break even after 1,000,000 bending, the test was stopped, and the result was indicated as "$>100\times10^4$ times".

Table 1 shows the results. Note that the column "production process" in Table 1 shows processes after the solid conductor was obtained.

TABLE 1

| | Alloy components (mass %) | | | | Grain diameter | Tensile strength | Electric conductivity | Number of bending ($\times10^4$ | Production |
|---|---|---|---|---|---|---|---|---|---|
| | Ni | Si | Others | Cu | (μm) | (MPa) | (% IACS) | times) | process |
| Example 1 | 1.2 | 0.28 | | Balance | 2.6 | 545 | 72.9 | >100 | Stranding → |
| Example 2 | 1.8 | 0.42 | | Balance | 3.0 | 570 | 64.2 | >100 | Compressing |
| Example 3 | 2.3 | 0.55 | | Balance | 3.7 | 603 | 59.1 | >100 | → Annealing |
| Example 4 | 2.5 | 0.59 | | Balance | 2.2 | 665 | 56.7 | >100 | |
| Example 5 | 3.0 | 0.70 | | Balance | 1.2 | 703 | 51.8 | >100 | |
| Example 6 | 4.2 | 0.92 | | Balance | 4.0 | 756 | 41.6 | >100 | |
| Example 7 | 1.3 | 0.29 | | Balance | 4.6 | 542 | 70.2 | >100 | |
| Example 8 | 1.6 | 0.36 | | Balance | 3.7 | 561 | 65.9 | >100 | |
| Example 9 | 2.2 | 0.52 | | Balance | 2.6 | 581 | 59.8 | >100 | |
| Example 10 | 2.6 | 0.55 | | Balance | 4.0 | 623 | 52.6 | >100 | |
| Example 11 | 2.9 | 0.67 | | Balance | 3.4 | 632 | 52.4 | >100 | |
| Example 12 | 3.4 | 0.77 | | Balance | 3.0 | 655 | 47.8 | >100 | |
| Example 13 | 1.8 | 0.43 | Sn: 0.46 | Balance | 2.2 | 621 | 50.4 | >100 | |
| Example 14 | 2.3 | 0.55 | Sn: 0.18 | Balance | 1.9 | 659 | 53.6 | >100 | |

TABLE 1-continued

| | Alloy components (mass %) | | | | Grain diameter | Tensile strength | Electric conductivity | Number of bending ($\times 10^4$ | Production |
|---|---|---|---|---|---|---|---|---|---|
| | Ni | Si | Others | Cu | (μm) | (MPa) | (% IACS) | times) | process |
| Example 15 | 2.8 | 0.63 | Sn: 0.20 | Balance | 2.4 | 700 | 47.6 | >100 | |
| Example 16 | 3.5 | 0.77 | Sn: 0.11 | Balance | 1.0 | 733 | 44.1 | >100 | |
| Example 17 | 1.5 | 0.34 | Sn: 0.63 | Balance | 2.0 | 606 | 47.9 | >100 | |
| Example 18 | 2.4 | 0.55 | Sn: 0.24 | Balance | 2.8 | 649 | 50.2 | >100 | |
| Example 19 | 2.8 | 0.58 | Sn: 0.22 | Balance | 3.4 | 674 | 45.4 | >100 | |
| Example 20 | 3.2 | 0.72 | Sn: 0.09 | Balance | 3.2 | 662 | 47.1 | >100 | |
| Example 21 | 4.2 | 0.95 | Sn: 0.13 | Balance | 2.6 | 732 | 40.4 | >100 | |
| Example 22 | 2.5 | 0.61 | Fe: 0.15 | Balance | 2.2 | 681 | 45.2 | >100 | |
| Example 23 | 1.6 | 0.42 | Cr: 0.14 | Balance | 2.2 | 584 | 58.8 | >100 | Stranding → |
| Example 24 | 3.0 | 0.73 | Cr: 0.05 | Balance | 2.5 | 678 | 44.2 | >100 | Compressing |
| Example 25 | 1.2 | 0.59 | Co: 1.20 | Balance | 2.5 | 686 | 40.7 | >100 | → Annealing |
| Example 26 | 2.6 | 0.68 | Co: 0.34 | Balance | 2.7 | 701 | 44.8 | >100 | |
| Example 27 | 2.8 | 0.66 | P: 0.01 | Balance | 2.2 | 657 | 44.2 | >100 | |
| Example 28 | 2.6 | 0.59 | P: 0.05 | Balance | 1.9 | 645 | 43.7 | >100 | |
| Example 29 | 1.8 | 0.41 | Ag: 0.19 | Balance | 3.3 | 581 | 55.1 | >100 | |
| Example 30 | 3.8 | 0.93 | Ag: 0.02 | Balance | 3.0 | 708 | 46.0 | >100 | |
| Example 31 | 3.2 | 0.76 | Sn: 0.20, Co: 0.24 | Balance | 1.6 | 655 | 43.9 | >100 | |
| Example 32 | 1.6 | 0.39 | Sn: 0.71, P: 0.08 | Balance | 2.2 | 589 | 40.1 | >100 | |
| Example 33 | 2.4 | 0.58 | Mg: 0.08 | Balance | 2.7 | 660 | 47.8 | >100 | |
| Example 34 | 2.5 | 0.58 | Mg: 0.14 | Balance | 2.2 | 668 | 44.8 | >100 | |
| Example 35 | 1.5 | 0.33 | Mn: 0.11 | Balance | 3.0 | 543 | 53.3 | >100 | |
| Example 36 | 1.7 | 0.41 | Mn: 0.33 | Balance | 2.7 | 562 | 42.5 | >100 | |
| Example 37 | 3.0 | 0.70 | Sn: 0.43, Ag: 0.12, Mg: 0.11 | Balance | 1.9 | 694 | 43.6 | >100 | |
| Example 38 | 4.1 | 0.96 | Fe: 0.08, Cr: 0.10, Mg: 0.04, Mn: 0.09 | Balance | 2.5 | 751 | 42.4 | >100 | |
| Example 39 | 2.5 | 0.57 | Fe: 0.10, P: 0.05, Mg: 0.06 | Balance | 2.5 | 650 | 40.9 | >100 | |
| Example 40 | 1.0 | 0.22 | Zn: 1.21 | Balance | 2.7 | 525 | 60.6 | >100 | |
| Example 41 | 2.8 | 0.67 | Zn: 0.35 | Balance | 3.0 | 663 | 44.9 | >100 | |
| Example 42 | 3.9 | 0.88 | Zn: 0.67 | Balance | 3.0 | 702 | 41.0 | >100 | |
| Example 43 | 2.0 | 0.47 | Fe: 0.05, Zn: 1.10 | Balance | 2.7 | 631 | 47.7 | >100 | |
| Example 44 | 2.2 | 0.52 | Sn: 0.20, Mg: 0.33, Zn: 0.62 | Balance | 3.0 | 745 | 44.1 | >100 | Stranding → Compressing |
| Example 45 | 2.4 | 0.53 | Sn: 0.18, Mg: 0.12, Zn: 1.20 | Balance | 3.4 | 721 | 47.3 | >100 | → Annealing |
| Example 46 | 2.3 | 0.52 | Sn: 0.15, Mg: 0.11, Zn: 0.52 | Balance | 1.9 | 693 | 49.5 | >100 | |
| Example 47 | 1.8 | 0.40 | Sn: 0.32, Mg: 0.08, Zn: 0.66 | Balance | 3.2 | 664 | 50.1 | >100 | |
| Example 48 | 2.6 | 0.66 | Sn: 0.68, Cr: 0.11, Mn: 0.12, Zn: 0.33 | Balance | 1.9 | 671 | 45.7 | >100 | |
| Example 49 | 2.3 | 0.55 | | Balance | 3.7 | 675 | 58.8 | >100 | Annealing → |
| Example 50 | 2.3 | 0.55 | Sn: 0.18 | Balance | 1.8 | 729 | 53.2 | >100 | Stranding → |
| Example 51 | 2.3 | 0.52 | Sn: 0.15, Mg: 0.11, Zn: 0.52 | Balance | 1.9 | 758 | 49.4 | >100 | Compressing |
| Example 52 | 2.3 | 0.55 | | Balance | 3.6 | 612 | 59.0 | >100 | Annealing → |
| Example 53 | 2.3 | 0.55 | Sn: 0.18 | Balance | 1.9 | 641 | 53.2 | >100 | Stranding → Compressing |
| Example 54 | 2.3 | 0.52 | Sn: 0.15, Mg: 0.11, Zn: 0.52 | Balance | 1.8 | 659 | 49.1 | >100 | → Low temperature annealing |
| Comparative example 1 | 0.8 | 0.30 | | Balance | 3.2 | 485 | 65.8 | 89.8 | Stranding → |
| Comparative example 2 | 4.7 | 1.03 | | Balance | 3.0 | 671 | 39.0 | 77.9 | Compressing |
| Comparative example 3 | 1.2 | 0.10 | | Balance | 4.6 | 478 | 59.9 | 86.4 | → Annealing |
| Comparative example 4 | 2.3 | 1.30 | | Balance | 2.4 | 521 | 44.2 | 95.3 | |
| Comparative example 5 | 2.3 | 0.53 | Sn: 1.20 | Balance | 3.7 | 722 | 34.7 | >100 | |
| Comparative example 6 | 2.1 | 0.50 | Fe: 0.51 | Balance | 2.5 | 689 | 41.0 | 98.8 | |
| Comparative example 7 | 2.5 | 0.56 | Cr: 0.66 | Balance | 2.2 | 670 | 40.4 | 95.4 | |
| Comparative example 8 | 3.6 | 0.85 | P: 0.38 | Balance | 2.7 | 691 | 23.9 | 78.2 | |
| Comparative example 9 | 2.4 | 0.54 | Mg: 0.55 | Balance | Breaking during production | | | | |
| Comparative example 10 | 2.7 | 0.65 | Mn: 0.67 | Balance | 2.2 | 682 | 29.1 | >100 | |
| Comparative example 11 | 2.3 | 0.54 | Zn: 1.82 | Balance | 2.5 | 692 | 38.9 | >100 | |
| Comparative example 12 | 1.8 | 0.40 | | Balance | 7.0 | 527 | 62.9 | 84.5 | |
| Comparative example 13 | 2.4 | 0.54 | | Balance | 15.0 | 588 | 56.3 | 88.5 | |
| Comparative example 14 | 0.8 | 0.40 | Sn: 0.14 | Balance | 24.0 | 481 | 66.5 | 72.2 | |
| Comparative example 15 | 3.6 | 0.83 | Sn: 0.20 | Balance | 45.0 | 701 | 43.0 | 87.3 | |
| Comparative example 16 | 2.5 | 1.00 | Sn: 0.17 | Balance | 8.0 | 538 | 48.0 | 79.1 | |
| Conventional example 1 | 1.6 | 0.6 | | Balance | 6.5 | 553 | 61.6 | 97.3 | Stranding → |
| Conventional example 2 | 2.4 | 0.6 | | Balance | 7.5 | 486 | 59.6 | 87.4 | Annealing |

In Table 1, Comparative Examples 1 to 4 and Comparative Examples 12 and 13 correspond to comparative examples of the invention according to the above item (1) (Examples 1 to 12, 49, and 52). Comparative Examples 5 to 8 and Comparative Examples 14 to 16 correspond to comparative examples of the invention according to the above item (2) (Examples 13 to 32, 50, and 53). Comparative Examples 9 and 10 correspond to comparative examples of the invention according to the above item (3) (Examples 33 to 39). Comparative Example 11 corresponds to a comparative example of the invention according to the above item (4) (Examples 40 to 48, 51, and 54).

As shown in Table 1, the conductors of Examples each did not break even after flexing 1,000,000 times and had excellent properties of tensile strength and electric conductivity exceeding a level satisfying a practical use. In general, a crimp strength of a terminal to an electric cable is substantially proportional to the tensile strength of the electric cable (the crimp strength is about 70% to about 80% of the tensile strength). Thus, enhanced tensile strength can provide an electric cable having high crimp strength.

That is, according to Examples of the present invention, an electric cable having excellent bending resistance and strength (tensile strength and crimp strength) can be obtained easily.

Meanwhile, Comparative Example 1 having a low Ni content was poor in tensile strength and bending resistance.

Comparative Example 2 having a high Ni content was poor in electric conductivity and bending resistance.

Comparative Example 3 having a low Si content was poor in tensile strength and bending resistance.

Comparative Example 4 having a high Si content was poor in bending resistance.

Comparative Examples 5 to 8 having a high Sn, Fe, Cr or P content each were poor in electric conductivity or bending resistance.

Comparative Example 9 having a high Mg content broke during the production process.

Comparative Examples 10 and 11 having a high Mn or Zn content each were poor in electric conductivity.

Comparative Examples 12 to 16 having a large grain diameter each were poor in bending resistance.

Conventional Examples 1 and 2 having a large grain diameter each were poor in bending resistance.

EXAMPLE 2

Further reduction in diameter of the solid conductor was evaluated for a part of Examples having alloy compositions shown in Table 1. To be specific, an alloy of a composition including alloy components as shown in Table 2 was melted in a high frequency melting furnace, to thereby cast each billet. Next, the billet was hot extruded at 900° C. and water hardened immediately, to thereby obtain a round bar. Then, the round bar was cold drawn to a diameter of 0.05 mm. The resultant was drawn to a length of about 3,000 km, and the number of breaking was counted. In this case, breaking due to a factor obviously excluding embrittlement was omitted from the count.

Table 2 shows the results.

TABLE 2

| | Alloy components (mass %) | | | | Drawn size | Number of breaking |
|---|---|---|---|---|---|---|
| | Ni | Si | Others | Cu | (ϕmm) | (times) |
| This invention 2 | 1.8 | 0.42 | | Balance | 0.05 | 2 |
| This invention 3 | 2.3 | 0.55 | | Balance | 0.05 | 6 |

TABLE 2-continued

| | Alloy components (mass %) | | | | Drawn size | Number of breaking |
|---|---|---|---|---|---|---|
| | Ni | Si | Others | Cu | (ϕmm) | (times) |
| This invention 4 | 2.5 | 0.59 | | Balance | 0.05 | 3 |
| This invention 33 | 2.4 | 0.58 | Mg: 0.08 | Balance | 0.05 | 0 |
| This invention 34 | 2.5 | 0.58 | Mg: 0.14 | Balance | 0.05 | 0 |
| This invention 35 | 1.5 | 0.33 | Mn: 0.11 | Balance | 0.05 | 0 |
| This invention 36 | 1.7 | 0.41 | Mn: 0.33 | Balance | 0.05 | 0 |

As Table 2 shows, Examples 33 to 36 each did not break even after drawing to a diameter of 0.05 mm and each were, as a copper alloy composition, suitable for an electric cable (solid conductor) having a small diameter. Meanwhile, Examples 2 to 4 containing neither Mg nor Mn each broke. As is clear from the results, for obtaining an electric cable (solid conductor) having a small diameter of 0.1 mm or less, for example, it is effective that Mg or Mn be included in an appropriate amount.

EXAMPLE 3

Solder bonding strength of the solid conductor was evaluated for a part of Examples having alloy compositions as shown in Table 1. To be specific, a copper alloy was cast so that each sample had an alloy composition as shown in Table 3, and hot extruded at 900° C., to thereby obtain a solution material round bar. Then, the round bar was drawn to a diameter of 1.0 mm and subjected to aging treatment at 450° C. for 2 hours, to thereby produce a conductor sample of an electric cable (length of 1 km). The conductor sample of an electric cable was inserted into a copper tube having an inner diameter of 3.0 mm such that only a length of 5 mm of the conductor sample of an electric cable was inserted. A gap between the sample and the copper tube was filled with solder (eutectic solder of Sn and Pb), and heated at 150° C. for 2 hours. Then, a load required for pulling out the solid conductor from the copper tube was measured, and this load was referred to as the solder bonding strength. A higher value indicates better adhesion with the solder. The solder bonding strength measurement was conducted three times for each sample, and Table 3 shows the average values.

TABLE 3

| | Alloy components (mass %) | | | | Solder bonding |
|---|---|---|---|---|---|
| | Ni | Si | Others | Cu | strength (N) |
| This invention 1 | 1.2 | 0.28 | | Balance | 34 |
| This invention 5 | 3.0 | 0.70 | | Balance | 25 |
| This invention 6 | 4.2 | 0.92 | | Balance | 29 |
| This invention 40 | 1.0 | 0.22 | Zn: 1.21 | Balance | 178 |
| This invention 41 | 2.8 | 0.67 | Zn: 0.35 | Balance | 148 |
| This invention 42 | 3.9 | 0.88 | Zn: 0.67 | Balance | 161 |

As Table 3 shows, Examples 40 to 42 each had a solder bonding strength of 100 N or more, which was a value preventing a bonding part from being detached due to vibration during component assembly or after loading to a device. Meanwhile, Examples 1, 5, and 6 containing no Zn each had a solder bonding strength of less than 100 N. As is clear from the results, for obtaining an electric cable having enhanced solder bonding strength (adhesion with solder), it is effective that Zn be included in an appropriate amount.

INDUSTRIAL APPLICABILITY

The conductor of an electric cable for wiring of the present invention has excellent bending resistance, strength (tensile strength and crimp strength), and electric conductivity, and thus is suitable as a conductor of an electric cable for wiring to be used for a signal electric cable for an automobile, robot or the like.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. § 119(a) on Patent Application No. 2005-354061 filed in Japan on Dec. 7, 2005, Patent Application No. 2006-109192 filed in Japan on Apr. 11, 2006, and Patent Application No. 2006-326369 filed in Japan on Dec. 1, 2006, each of which is entirely herein incorporated by reference.

The invention claimed is:

1. A conductor of an electric cable for wiring, comprising a copper alloy material containing 1.0 to 4.5 mass % of Ni, 0.2 to 1.1 mass % of Si, and the balance of Cu and unavoidable impurities, wherein the copper alloy material has an average grain diameter of 0.2 to 5.0 μm.

2. The conductor of an electric cable for wiring according to claim 1, wherein a copper alloy of the copper alloy material further contains 0.1 to 1.5 mass % of Zn.

3. The conductor of an electric cable for wiring according to claim 1, wherein a copper alloy of the copper alloy material further contains at least one of 0.01 to 0.5 mass % of Mn and 0.05 to 0.5 mass % of Mg.

4. The conductor of an electric cable for wiring according to claim 3, wherein a copper alloy of the copper alloy material further contains 0.1 to 1.5 mass % of Zn.

5. A method of producing the conductor of an electric cable for wiring according to claim 1, which conducts hot extrusion.

6. An electric cable for wiring formed by stranding a plurality of the conductors of an electric cable for wiring according to claim 1.

7. A method of producing the electric cable for wiring according to claim 6, comprising the steps of:

subjecting a copper alloy to solution treatment;

stranding a plurality of conductors of an electric cable each obtained by drawing the copper alloy subjected to said solution treatment to a predetermined wire diameter;

compressing the plurality of conductors stranded; and conducting age annealing of the plurality of conductors stranded and compressed at 300 to 550° C. for 1 minute to 5 hours.

8. A method of producing the electric cable for wiring according to claim 6, comprising the steps of:

subjecting a copper alloy to solution treatment;

conducting age annealing of a plurality of conductors of an electric cable each obtained by drawing the copper alloy subjected to said solution treatment to a predetermined wire diameter at 300 to 550° C. for 1 minute to 5 hours;

stranding the plurality of conductors age-annealed; and compressing the plurality of conductors age-annealed and stranded.

9. A method of producing the electric cable for wiring according to claim 6, comprising the steps of:

subjecting a copper alloy to solution treatment;

conducting age annealing of a plurality of conductors of an electric cable each obtained by drawing the copper alloy subjected to said solution treatment to a predetermined wire diameter at 300 to 550° C. for 1 minute to 5 hours;

stranding the plurality of conductors age-annealed;

compressing the plurality of conductors age-annealed and stranded; and conducting low-temperature annealing for distortion relieve of the plurality of conductors age-annealed, stranded and compressed.

10. A conductor of an electric cable for wiring, comprising a copper alloy material containing 1.0 to 4.5 mass % of Ni, 0.2 to 1.1 mass % of Si, at least one of 0 to 1.0 mass % of Sn, 0.005 to 0.2 mass % of Fe, 0.005 to 0.2 mass % of Cr, 0.05 to 2 mass % of Co, 0.005 to 0.1 mass % of P and 0.005 to 0.3 mass % of Ag, and the balance of Cu and unavoidable impurities, wherein the copper alloy material has an average grain diameter of 0.2 to 5.0 μm.

11. The conductor of an electric cable for wiring according to claim 10, wherein a copper alloy of the copper alloy material further contains 0.1 to 1.5 mass % of Zn.

12. The conductor of an electric cable for wiring according to claim 10, wherein a copper alloy of the copper alloy material further contains at least one of 0.01 to 0.5 mass % of Mn and 0.05 to 0.5 mass % of Mg.

13. The conductor of an electric cable for wiring according to claim 12, wherein a copper alloy of the copper alloy material further contains 0.1 to 1.5 mass % of Zn.

14. A method of producing the conductor of an electric cable for wiring according to claim 10, which conducts hot extrusion.

15. An electric cable for wiring formed by stranding a plurality of the conductors of an electric cable for wiring according to claim 10.

16. A method of producing the electric cable for wiring according to claim 15, comprising the steps of:

subjecting a copper alloy to solution treatment;

stranding a plurality of conductors of an electric cable each obtained by drawing the copper alloy subjected to said solution treatment to a predetermined wire diameter;

compressing the plurality of conductors stranded; and conducting age annealing of the plurality of conductors stranded and compressed at 300 to 550° C. for 1 minute to 5 hours.

17. A method of producing the electric cable for wiring according to claim 15, comprising the steps of:

subjecting a copper alloy to solution treatment;

conducting age annealing of a plurality of conductors of an electric cable each obtained by drawing the copper alloy subjected to said solution treatment to a predetermined wire diameter at 300 to 550° C. for 1 minute to 5 hours;

stranding the plurality of conductors age-annealed; and compressing the plurality of conductors age-annealed and stranded.

18. A method of producing the electric cable for wiring according to claim 15, comprising the steps of:

subjecting a copper alloy to solution treatment;

conducting age annealing of a plurality of conductors of an electric cable each obtained by drawing the copper alloy subjected to said solution treatment to a predetermined wire diameter at 300 to 550° C. for 1 minute to 5 hours;

stranding the plurality of conductors age-annealed;

compressing the plurality of conductors age-annealed and stranded; and conducting low-temperature annealing for distortion relieve of the plurality of conductors age-annealed, stranded and compressed.

* * * * *